US010687672B1

(12) United States Patent
Bynog

(10) Patent No.: US 10,687,672 B1
(45) Date of Patent: Jun. 23, 2020

(54) SINK DRAIN STOPPER DECORATIVE CAP

(71) Applicant: Joseph Bynog, Round Rock, TX (US)

(72) Inventor: Joseph Bynog, Round Rock, TX (US)

( * ) Notice: Subject to any disclaimer, the term of this patent is extended or adjusted under 35 U.S.C. 154(b) by 0 days.

(21) Appl. No.: 16/253,274

(22) Filed: Jan. 22, 2019

Related U.S. Application Data

(60) Provisional application No. 62/627,410, filed on Feb. 7, 2018.

(51) Int. Cl.
*A47K 1/14* (2006.01)

(52) U.S. Cl.
CPC ..... *A47K 1/14* (2013.01)

(58) Field of Classification Search
CPC ..... A47K 1/14
USPC ..... 4/286–295
See application file for complete search history.

(56) References Cited

U.S. PATENT DOCUMENTS 5,330,811 A 7/1994 Buchalter
6,957,452 B2 10/2005 Grant
8,360,590 B2 1/2013 Carter
9,585,523 B1 * 3/2017 Brannan ..... A47K 1/14
D783,783 S 4/2017 Yang
9,706,881 B1 7/2017 Brannan
2006/0090257 A1 5/2006 Geller
2018/0235406 A1 * 8/2018 O'Reilly ..... A47K 3/001

* cited by examiner

*Primary Examiner* — Christine J Skubinna
(74) *Attorney, Agent, or Firm* — Kyle A. Fletcher, Esq.

(57) ABSTRACT

The sink drain stopper decorative cap may couple to the top of a drain stopper in a sink. The embellishment may enhance the appearance and/or supplement the function of the drain stopper. A decorative embellishment may be a 3-dimensional adornment. The decorative embellishment may be visible within the sink and may improve the appearance of the sink by adding a decorative element to the sink. A functional embellishment may be a battery operated device that provides a useful sink function. As non-limiting examples, useful sink functions may comprise indicating the date and/or time, providing illumination, timing an interval, playing music, projecting an image, monitoring the temperature of the water coming from the faucet, or combinations thereof.

18 Claims, 5 Drawing Sheets

SINK DRAIN STOPPER DECORATIVE CAP

CROSS REFERENCES TO RELATED APPLICATIONS

This application claims the benefit of U.S. Provisional Application No. 62/627,410, filed Feb. 7, 2018.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of sink accessories, more specifically, a sink drain stopper decorative cap.

SUMMARY OF INVENTION

The sink drain stopper decorative cap may couple to the top of a drain stopper in a sink. The embellishment may enhance the appearance and/or supplement the function of the drain stopper. A decorative embellishment may be a 3-dimensional adornment. The decorative embellishment may be visible within the sink and may improve the appearance of the sink by adding a decorative element to the sink. A functional embellishment may be a battery operated device that provides a useful sink function. As non-limiting examples, useful sink functions may comprise indicating the date and/or time, providing illumination, timing an interval, playing music, projecting an image, monitoring the temperature of the water coming from the faucet, or combinations thereof.

An object of the invention is to provide an embellishment for the top of a drain stopper in a sink.

Another object of the invention is to couple the embellishment to the stopper via a cap base and lip.

A further object of the invention is to provide an embellishment that is decorative in nature.

Yet another object of the invention is to provide an embellishment that is functional in nature.

These together with additional objects, features and advantages of the sink drain stopper decorative cap will be readily apparent to those of ordinary skill in the art upon reading the following detailed description of the presently preferred, but nonetheless illustrative, embodiments when taken in conjunction with the accompanying drawings.

In this respect, before explaining the current embodiments of the sink drain stopper decorative cap in detail, it is to be understood that the sink drain stopper decorative cap is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the sink drain stopper decorative cap.

It is therefore important that the claims be regarded as including such equivalent construction insofar as they do not depart from the spirit and scope of the sink drain stopper decorative cap. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
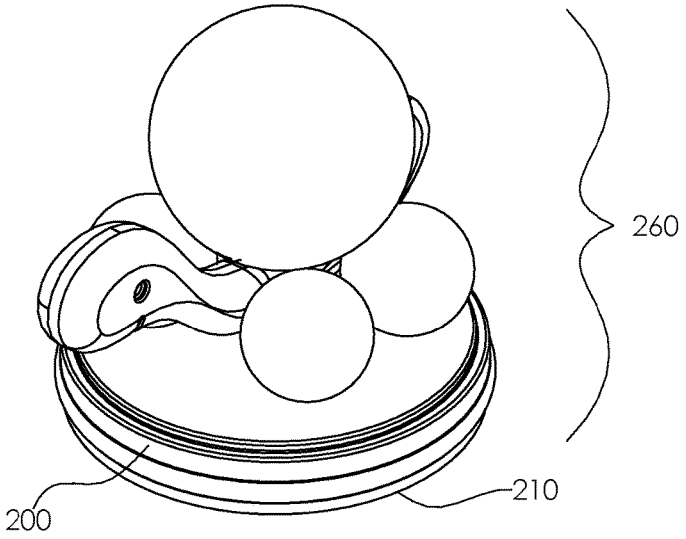
FIG. 1 is a perspective view of an embodiment of the disclosure illustrating a decorative embellishment suggestive of a stylized turtle.
Figure 2:
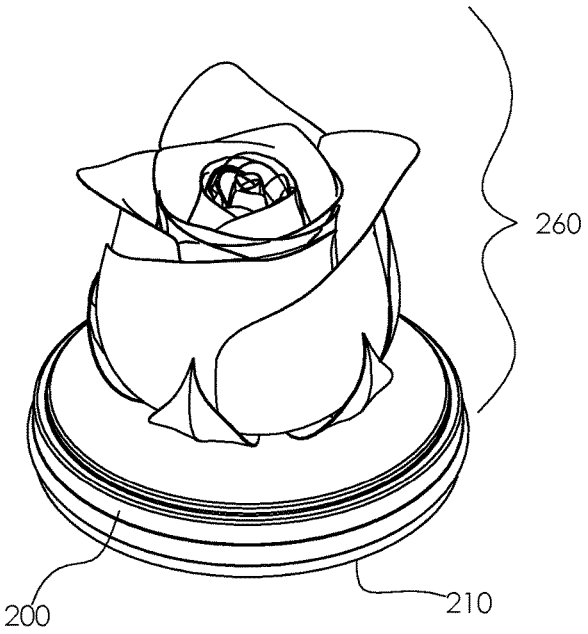
FIG. 2 is a perspective view of an embodiment of the disclosure illustrating a decorative embellishment suggestive of a flower.
Figure 3:
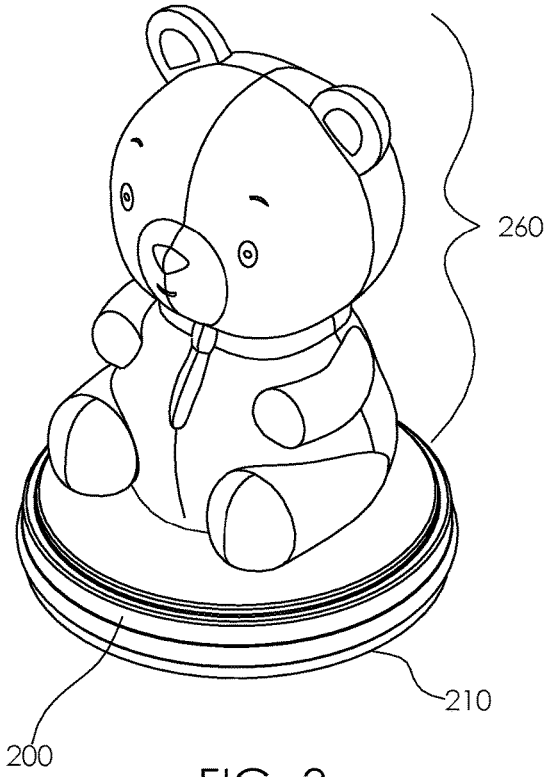
FIG. 3 is a perspective view of an embodiment of the disclosure illustrating a decorative embellishment suggestive of a toy.
Figure 4:
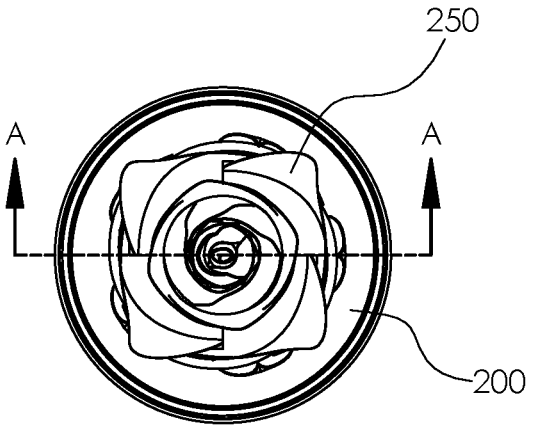
FIG. 4 is a top view of an embodiment of the disclosure.
Figure 4A:
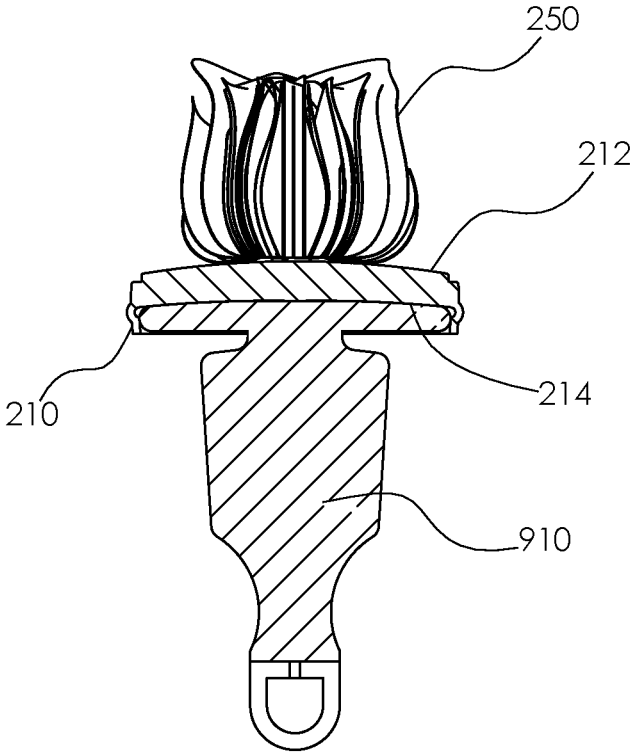
FIG. 4A is a cross-sectional view of an embodiment of the disclosure across A-A as shown in FIG. 4.
Figure 5:
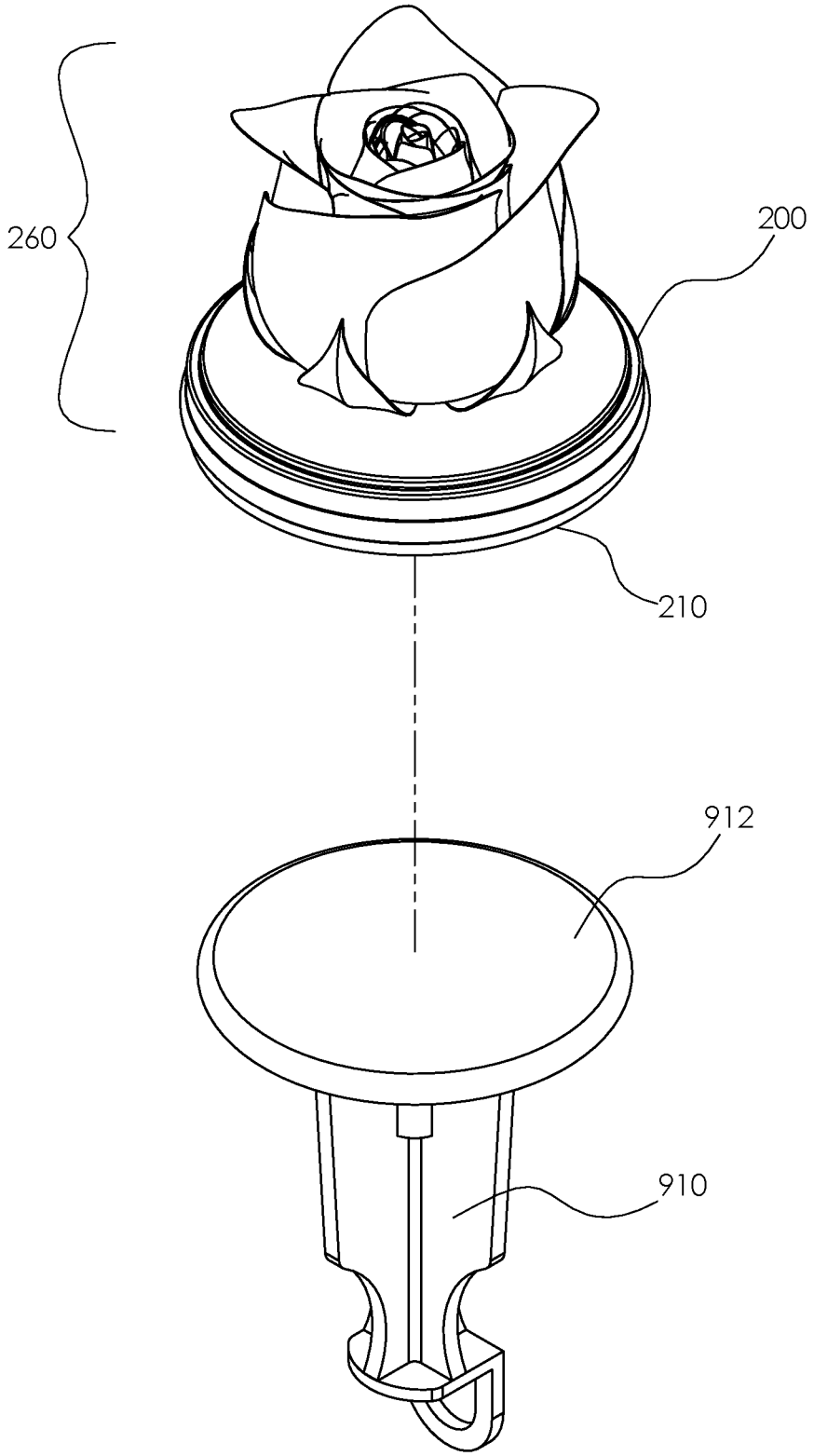
FIG. 5 is a detail view of an embodiment of the disclosure illustrating the coupling of the invention onto a drain stopper.
Figure 6:
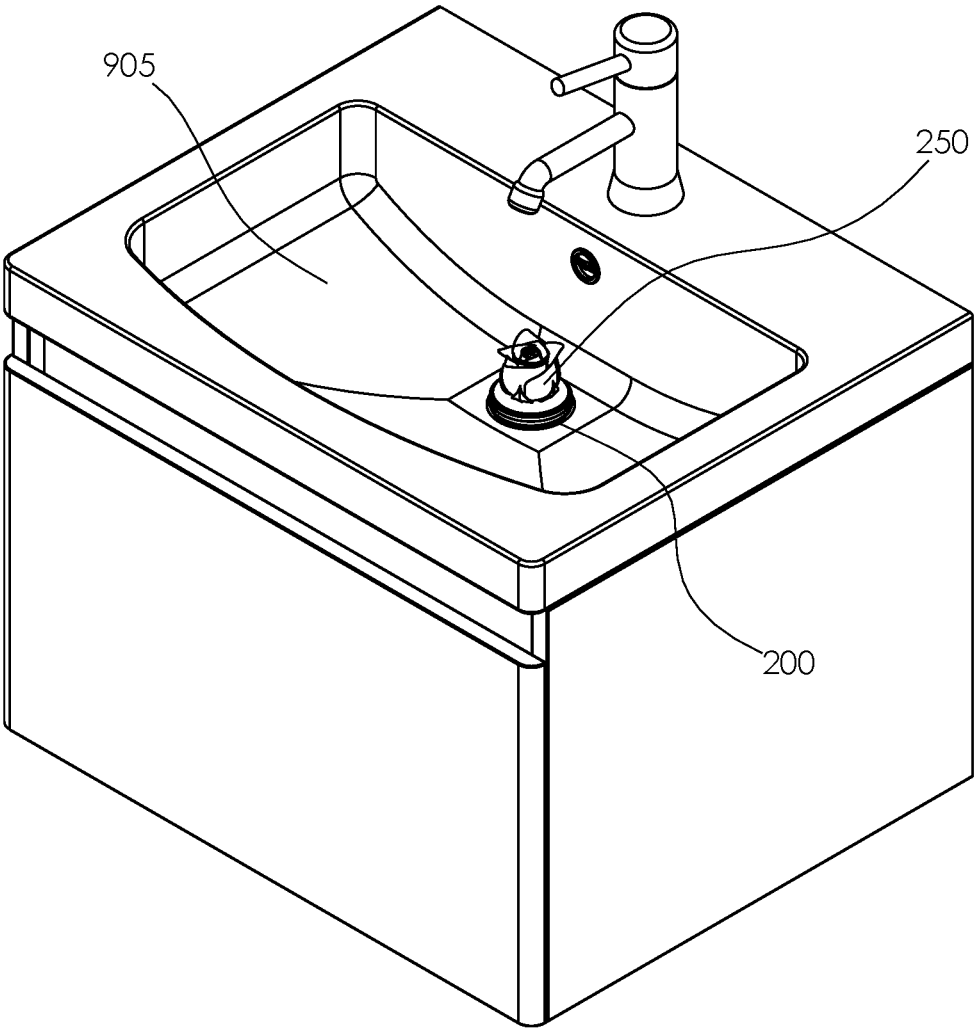
FIG. 6 is an in-use view of an embodiment of the disclosure.
Figure 7:
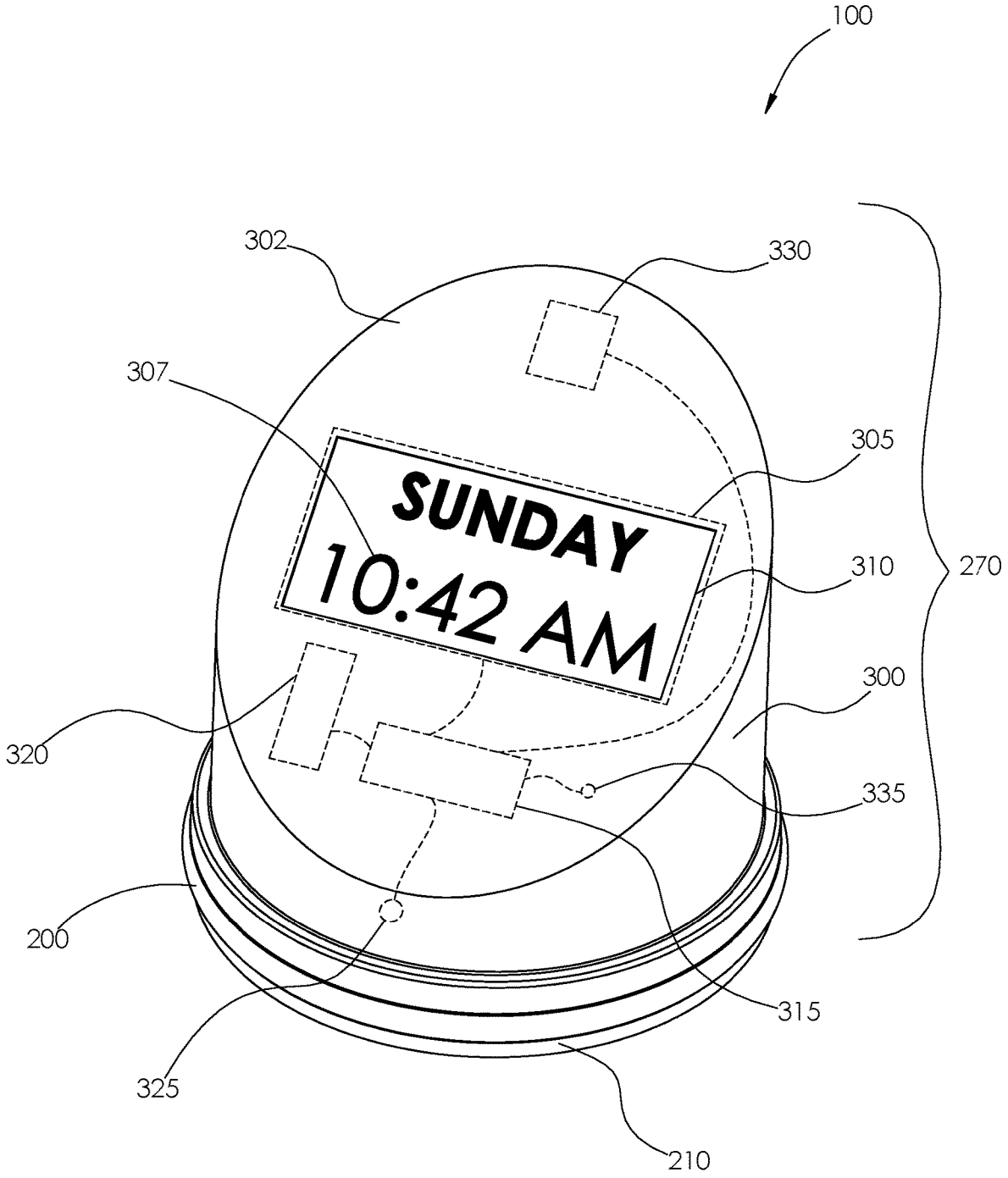
FIG. 7 is a perspective view of an embodiment of the disclosure illustrating a functional embellishment which is a clock.

Detailed reference will now be made to a first potential embodiment of the disclosure, which is illustrated in FIGS. 1 through 7.

The sink drain stopper decorative cap 100 (hereinafter invention) comprises a cap base 200, a lip 210, and an embellishment 250. The invention 100 may couple to the top of a drain stopper 910 in a sink 905. The embellishment 250 may enhance the appearance and/or supplement the function of the drain stopper 910.

The cap base 200 may be a disk oriented to lay in a substantially horizontal plane. The cap base 200 may comprise a cap upper surface 212 and a cap lower surface 214. The diameter of the cap base 200 may be at least as large as the diameter of a stopper top surface 912. The cap lower surface 214 may rest upon the stopper top surface 912. The cap upper surface 212 may couple to the embellishment 250. As non-limiting examples, the cap base 200 may be made of natural or synthetic rubber, silicone, or other flexible polymer.

The lip 210 may extend downward from the outside edge of the cap lower surface 214. The lip 210 may wrap around the outer edge of the drain stopper 910 to couple the cap base 200 to the drain stopper 910 when the invention 100 is installed on the drain stopper 910. The bottom edge of the lip 210 may form a seal with the sink 905 when the drain stopper 910 is lowered into a drain.

The embellishment 250 may be coupled to the top of the cap base 200 such that the embellishment 250 may be visible within the sink 905 whether the drain stopper 910 is blocking the flow of water or not. The embellishment 250 may be decorative, functional, or a combination thereof.

A decorative embellishment 260 may be a 3-dimensional adornment. The decorative embellishment 260 may be visible within the sink 905 and may improve the appearance of the sink 905 by adding a decorative element to the sink 905. As non-limiting examples, the decorative embellishment 260 may be a stylized turtle (see FIG. 1), a flower (see FIG. 2), or a toy (see FIG. 3).

A functional embellishment 270 may be a battery operated device that provides a useful sink function. As non-limiting examples, useful sink functions may comprise indicating the date and/or time, providing illumination, timing an interval, playing music, projecting an image, monitoring the temperature of the water coming from the faucet, or combinations thereof.

As a non-limiting example, the functional embellishment 270 may be a clock. The clock may comprise a clock housing 300, a display 305, a controller 315, and one or more batteries 320. The clock housing 300 may be an enclosure for the display 305, the controller 315, and the one or more batteries 320. As a non-limiting example, the clock housing 300 may be a vertically oriented cylinder comprising a truncated top with a clock top surface 302 oriented at an oblique angle relative to horizontal and vertical references. The clock housing 300 may be watertight. The clock top surface 302 may comprise a window 310 that may be transparent such that information 307 shown on the display 305 may be read from outside of the clock housing 300 through the window 310.

The display 305 may be a numeric, alphanumeric, or graphical display mounted inside the clock housing 300 and adjacent to the window 310. The display 305 may be electrically coupled to the one or more batteries 320 and to the controller 315. As non-limiting examples, the information 307 shown on the display 305 may comprise the time, the date, the day of the week, or combinations thereof.

The controller 315 may control the operation of the functional embellishment 270. The controller 315 may be electrically coupled to the one or more batteries 320. As a non-limiting example, the controller 315 may be a single chip microprocessor that comprises a CPU, volatile and non-volatile memory, and I/O ports necessary for sensing and controlling the one or more batteries 320 and the display 305 in accordance with a program stored in the non-volatile memory.

The one or more batteries 320 may comprise one or more energy-storage devices. The one or more batteries 320 may be a source of electrical energy to operate the controller 315 and the display 305. The one or more batteries 320 may be replaceable or rechargeable.

The clock may further comprise one or more lights 325. The one or more lights 325 may be electrically coupled to the controller 315. The one or more lights 325 may provide illumination within the sink 905. In some embodiments, the one or more lights 325 may be turned on and off in accordance with a timing schedule determined by the controller 315. In some embodiments, the color of the one or more lights 325 may change to indicate the water temperature as determined by a temperature sensor 335 within the clock housing 300 that is electrically coupled to the controller 315.

The clock may further comprise a sound transducer 330. The sound transducer 330 may convert an audio output signal into an audible sound. As non-limiting examples, the sound transducer 330 may be one or more loudspeakers or one or more piezoelectric transducers. The audio output signal may be an electrical signal that is modulated by the controller 315. The sound transducer 330 may be electrically coupled to the controller 315. As a non-limiting example, the audible sound may be music.

In use, the invention 100 is installed onto the drain stopper 910 by placing the cap base 200 onto the stopper top surface 912 and pressing the invention 100 down until the lip 210 surrounds the drain stopper 910. As non-limiting examples, if the embellishment 250 is the functional embellishment 270, a user may be able to see the time, benefit from illumination in the dark, listen to music, or be warned about hot water coming from the faucet.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

As used in this disclosure, a "clock" is an instrument that measures the passage of time. Clocks are often synchronized to a reference time that allows for communities to coordinate the scheduling of activities.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw.

As used herein, the words "couple", "couples", "coupled" or "coupling", refer to connecting, either directly or indirectly, and does not necessarily imply a mechanical connection.

As used in this disclosure, a "cylinder" is a geometric structure defined by two identical flat and parallel ends, also commonly referred to as bases, which are circular in shape and connected with a single curved surface which may be referred to as the face. The axis of the cylinder is formed by the straight line that connects the center of each of the two identical flat and parallel ends of the cylinder. Unless otherwise stated within this disclosure, the term cylinder specifically indicates a right cylinder which is defined as a cylinder wherein the curved surface perpendicularly intersects with the two identical flat and parallel ends.

As used herein, the words "data" and "information" are used interchangeably to refer to raw, unprocessed facts and to facts that have been processed, structured, organized, or presented in a context that makes the facts useful.

As used in this disclosure, "decorative" is an adjective that refers to a first object or item that is used with a second object or item of the purpose of making the second object or item more attractive. Decorative will generally, but not necessarily, imply making the second object or item more attractive visually.

As used in this disclosure, a "diameter" of an object is a straight line segment that passes through the center (or center axis) of an object. The line segment of the diameter is terminated at the perimeter or boundary of the object through which the line segment of the diameter runs.

As used in this disclosure, a "disk" is a cylindrically shaped object with parallel opposing sides. A disk generally has a thickness (as measured from flat side to flat side) that is less than the radius of the cylinder.

As used in this disclosure, a "display" is a surface upon which is presented an image, potentially including, but not limited to, graphic images and text, that is interpretable by an individual viewing the image. When used as a verb, "display" is defined as presenting such an image.

As used in this disclosure, "flexible" refers to an object or material which will deform when a force is applied to it, which will not return to its original shape when the deforming force is removed, and which may not retain the deformed shape caused by the deforming force.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, a "housing" is a rigid casing that encloses and protects one or more devices.

As used herein, "oblique angle" refers to any angle that is not a right angle or a multiple of a right angle.

As used herein, the terms "processor", "central processor", "central processing unit", "CPU", or "microprocessor" refer to a digital device that carries out the instructions comprising a computer program by performing basic arithmetic, logical, control, and input/out operations. The term "microprocessor" may additionally imply a level of miniaturization and power reduction that makes the device suitable for portable or battery operated systems.

As used in this disclosure, a "sensor" is a device that quantitatively measures a physical stimulus.

As used in this disclosure, a "sink" is a permanently installed water basin that is attached to one or more water sources.

As used in this disclosure, a "speaker" is an electrical transducer that converts an electrical signal into an audible sound; also known as a loudspeaker.

As used herein, the word "substantially" indicates that two or more attributes are the same except for a margin of error related to variances in materials, manufacturing processes, craftsmanship, installation, environmental conditions, or other factors that may influence the attributes and that the differences introduced by these factors are not considered detrimental to the operation of the invention as described herein.

As used herein, "substantially horizontal" refers to the orientation of one or more elements. Substantially horizontal elements are within 22.5 degrees of a true horizontal orientation.

As used in this disclosure, a "transducer" is a device that converts a physical quantity, such as pressure or brightness into an electrical signal or a device that converts an electrical signal into a physical quantity.

As used in this disclosure, "transparent" refers to a material that allows light to pass through the material without significant scattering such that an object can be clearly seen through the material.

As used in this disclosure, a geometric object is "truncated" when an apex, vertex, or end is cut off by a line or plane.

As used in this disclosure, "vertical" refers to a direction that is parallel to the local force of gravity. Unless specifically noted in this disclosure, the vertical direction is always perpendicular to horizontal.

As used herein, the word "watertight" refers to a barrier that is impermeable to water.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A sink drain stopper decorative cap comprising:

a cap base, a lip, and an embellishment;

wherein the sink drain stopper decorative cap couples to the top of a drain stopper in a sink;

wherein the embellishment enhances the appearance and/or supplement the function of the drain stopper;

wherein the embellishment is coupled to the top of the cap base such that the embellishment is visible within the sink whether the drain stopper is blocking the flow of water or not;

wherein the embellishment is decorative, functional, or a combination thereof;

wherein the functional embellishment is a clock;

wherein the clock comprises a clock housing, a display, a controller, and one or more batteries.

2. The sink drain stopper decorative cap according to claim 1 wherein the cap base is a disk oriented to lay in a substantially horizontal plane;

wherein the cap base comprises a cap upper surface and a cap lower surface;

wherein the diameter of the cap base is at least as large as the diameter of a stopper top surface;

wherein the cap lower surface rests upon the stopper top surface;

wherein the cap upper surface couples to the embellishment.

3. The sink drain stopper decorative cap according to claim 2 wherein the cap base is made of natural or synthetic rubber, silicone, or other flexible polymer.

4. The sink drain stopper decorative cap according to claim 2 wherein the lip extends downward from the outside edge of the cap lower surface;

wherein the lip wraps around the outer edge of the drain stopper to couple the cap base to the drain stopper when the sink drain stopper decorative cap is installed on the drain stopper;

wherein the bottom edge of the lip forms a seal with the sink when the drain stopper is lowered into a drain.

5. The sink drain stopper decorative cap according to claim 4 wherein a decorative embellishment is a 3-dimensional adornment;

wherein the decorative embellishment is visible within the sink and improves the appearance of the sink by adding a decorative element to the sink.

6. The sink drain stopper decorative cap according to claim 4 wherein a functional embellishment is a battery operated device that provides a useful sink function.

7. The sink drain stopper decorative cap according to claim 6 wherein useful sink functions comprises indicating the date and/or time, providing illumination, timing an interval, playing music, projecting an image, monitoring the temperature of the water coming from the faucet, or combinations thereof.

8. The sink drain stopper decorative cap according to claim 7 wherein the clock housing is an enclosure for the display, the controller, and the one or more batteries;

wherein the clock housing is a vertically oriented cylinder comprising a truncated top with a clock top surface oriented at an oblique angle relative to horizontal and vertical references;

wherein the clock housing is watertight;

wherein the clock top surface comprises a window that is transparent such that information shown on the display is readable from outside of the clock housing through the window.

9. The sink drain stopper decorative cap according to claim 8 wherein the display is a numeric, alphanumeric, or graphical display mounted inside the clock housing and adjacent to the window;

wherein the display is electrically coupled to the one or more batteries and to the controller.

10. The sink drain stopper decorative cap according to claim 9 wherein the information shown on the display comprises the time, the date, the day of the week, or combinations thereof.

11. The sink drain stopper decorative cap according to claim 9 wherein the controller controls the operation of the functional embellishment;

wherein the controller is electrically coupled to the one or more batteries.

12. The sink drain stopper decorative cap according to claim 11 wherein the controller is a single chip microprocessor that comprises a CPU, volatile and non-volatile memory, and I/O ports necessary for sensing and controlling the one or more batteries and the display in accordance with a program stored in the non-volatile memory.

13. The sink drain stopper decorative cap according to claim 11 wherein the one or more batteries comprise one or more energy-storage devices;

wherein the one or more batteries are a source of electrical energy to operate the controller and the display;

wherein the one or more batteries are replaceable or rechargeable.

14. The sink drain stopper decorative cap according to claim 13 wherein the clock further comprises one or more lights;

wherein the one or more lights are electrically coupled to the controller;

wherein the one or more lights provide illumination within the sink.

15. The sink drain stopper decorative cap according to claim 14 wherein the one or more lights are turned on and off in accordance with a timing schedule determined by the controller.

16. The sink drain stopper decorative cap according to claim 15 wherein the color of the one or more lights change to indicate the water temperature as determined by a temperature sensor within the clock housing that is electrically coupled to the controller.

17. The sink drain stopper decorative cap according to claim 15 wherein the clock further comprises a sound transducer;

wherein the sound transducer converts an audio output signal into an audible sound.

18. The sink drain stopper decorative cap according to claim 17 wherein the sound transducer is one or more loudspeakers or one or more piezoelectric transducers;

wherein the audio output signal is an electrical signal that is modulated by the controller;

wherein the sound transducer is electrically coupled to the controller.

* * * * *